US009321587B2

(12) United States Patent
Jian et al.

(10) Patent No.: US 9,321,587 B2
(45) Date of Patent: Apr. 26, 2016

(54) LOCKING SYSTEM APPLICABLE IN LARGE CONTAINER

(75) Inventors: Yuanli Jian, Shanghai (CN); Qingxin Liao, Shanghai (CN); Zuocheng Qian, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 0 days.

(21) Appl. No.: 14/348,364

(22) PCT Filed: Jul. 9, 2012

(86) PCT No.: PCT/CN2012/078371

§ 371 (c)(1),
(2), (4) Date: May 7, 2014

(87) PCT Pub. No.: WO2013/044665

PCT Pub. Date: Apr. 4, 2013

(65) Prior Publication Data

US 2014/0326721 A1 Nov. 6, 2014

(30) Foreign Application Priority Data

Sep. 29, 2011 (CN) ..... 2011 1 0295392

(51) Int. Cl.
*E05C 1/06* (2006.01)
*B65D 90/00* (2006.01)
(Continued)

(52) U.S. Cl.
CPC ..... *B65D 90/008* (2013.01); *B65D 19/06* (2013.01); *B65D 88/52* (2013.01); *B65D 90/623* (2013.01);
(Continued)

(58) Field of Classification Search
CPC ..... E05C 1/12; E05C 1/14; E05C 1/145
USPC ..... 292/137, 138, 143, 163, 173
See application file for complete search history.

(56) References Cited

U.S. PATENT DOCUMENTS 2,006,263 A * 6/1935 Coomes ..... 292/173
2,142,845 A * 1/1939 Hogg ..... 292/173
(Continued)

FOREIGN PATENT DOCUMENTS

CN 101161972 4/2008
CN 201367208 12/2009
(Continued)

OTHER PUBLICATIONS

International Search Report for PCT/CN2012/078371 dated Sep. 20, 2012.
(Continued)

*Primary Examiner* — Carlos Lugo
(74) *Attorney, Agent, or Firm* — Hamre, Schumann, Mueller & Larson, P.C.

(57) ABSTRACT

A locking system applicable in a large container comprises a first component, a second component, and a latch (10). The latch (10) is movably received within the first component, and correspondingly the second component is provided with a groove (14) to receive a section of the latch (10) extending from the receiving section of the first component. The locking system also comprises a handle (9). The handle (9) is arranged on the first component via pivot shafts (13) and is allowed to turn towards an outer side of the first component. The handle (9) is provided at a section thereof away from the pivot shaft (13) with male pins (11). The latch (10) is provided with concave profiles in correspondence to the male pin (11). The male pin (11) and the concave profile (12) are engaged to form a sliding pair. Furthermore, the handle (9) and the latch (10) constitute a lever system. The lever system uses the pivot shaft (13) as a fulcrum, the handle (9) as a driving member, and the latch (10) as a driven member, where the distance between a force-exerting section of the handle (9) and the fulcrum is greater than the distance from the sliding pair to the fulcrum. The locking system has the advantages of effortless operation, easy installation, and, when in use, improved conformation of movements to gesture habits of people.

7 Claims, 2 Drawing Sheets

(51) Int. Cl.

| | |
|---|---|
| ***E05B 83/02*** | (2014.01) |
| ***E05C 1/14*** | (2006.01) |
| ***B65D 19/06*** | (2006.01) |
| ***B65D 88/52*** | (2006.01) |
| ***B65D 90/62*** | (2006.01) |
| *E05C 1/00* | (2006.01) |
| *E05C 1/12* | (2006.01) |
| *E05B 5/00* | (2006.01) |

(52) U.S. Cl.

CPC ..... *E05B 83/02* (2013.01); *E05C 1/145* (2013.01); *B65D 2251/1058* (2013.01); *B65D 2251/1075* (2013.01); *B65D 2519/009* (2013.01); *B65D 2519/00333* (2013.01); *B65D 2519/00497* (2013.01); *B65D 2519/00502* (2013.01); *B65D 2519/00611* (2013.01); *B65D 2519/00646* (2013.01); *B65D 2519/00805* (2013.01); *E05B 5/00* (2013.01); *E05C 1/12* (2013.01)

(56) References Cited

U.S. PATENT DOCUMENTS

| | | | | | |
|---|---|---|---|---|---|
| 2,649,322 | A * | 8/1953 | Grant | ..... | 292/173 |
| 2,764,440 | A * | 9/1956 | Marko | ..... | 292/173 |
| 2,874,986 | A * | 2/1959 | Henrichs | ..... | 292/167 |
| 3,141,693 | A * | 7/1964 | Fugit | ..... | 292/173 |
| 3,724,889 | A * | 4/1973 | Dooley | ..... | 292/87 |
| 4,508,377 | A * | 4/1985 | Takasaki | ..... | 292/166 |
| 4,923,079 | A | 5/1990 | Foy | | |
| 5,062,671 | A * | 11/1991 | Goetz et al. | ..... | 292/175 |
| 5,161,709 | A | 11/1992 | Oestreich, Jr. | | |
| 5,193,707 | A * | 3/1993 | Mizumura | ..... | 220/326 |
| 8,182,001 | B2 * | 5/2012 | Tremble et al. | ..... | 292/32 |
| 8,534,718 | B2 * | 9/2013 | Loret de Mola | ..... | 292/173 |
| 8,899,632 | B2 * | 12/2014 | Tremble et al. | ..... | 292/32 |
| 2006/0255596 | A1 * | 11/2006 | Yong | ..... | 292/173 |
| 2011/0025074 | A1 * | 2/2011 | Reznar | ..... | 292/33 |
| 2011/0109103 | A1 | 5/2011 | Huston et al. | | |

FOREIGN PATENT DOCUMENTS

| | | | | |
|---|---|---|---|---|
| CN | 201367211 | | 12/2009 | |
| CN | 102530437 | | 7/2012 | |
| CN | 202295926 | U | 7/2012 | |
| DE | 688898 | | 3/1940 | |
| EP | 1526236 | A2 * | 4/2005 | ..... E05B 63/20 |
| FR | 2852049 | | 9/2004 | |
| GB | 2 384 482 | | 7/2003 | |
| WO | WO 2005/102852 | | 11/2005 | |

OTHER PUBLICATIONS

Extended European Search Report, May 11, 2015; European Patent Application No. 12836088.0 (6 pages).

* cited by examiner

LOCKING SYSTEM APPLICABLE IN LARGE CONTAINER

TECHNICAL FIELD

The present disclosure relates to a locking system in the walls of a large container which can be folded.

BACKGROUND OF THE INVENTION

There is a container which comprises a collapsible and removable side walls and a base connected to the side walls, such connection generally in forms of a hinge. A small door may be provided on a side wall, which is used to reach the interior of the container without having to open or disassemble the whole side wall. Such container is well known, especially a large container used for transport and storage of various objects, such as a single object or bulk material. Such container may be folded when it is empty, so that the height of the container considerably shorter, the occupied space is largely reduced so as to be shipped back for re-loading. Further, one or more side walls may be removed for replacing with a new one. Moreover, it is convenient for user to pick up goods from the bottom of the container when a side wall is provided with a small door.

Usually, the side walls are hinged at its lower end to the base of the container using hinges, and the small door is hinged to the side wall by a hinge too. By rotation around the hinge, the side walls may switch between an upright position and a lying down position. The small door in the side wall also be opened and closed by rotation of a hinge.

When using the container, the side walls of the container needs to be remained upright and the small door needs to be kept closed, thus a locking means is needed to hold them in a desired state.

To achieve the above object, an engagement structure is provided between the adjacent side walls, which lead to partly locking the adjacent side walls. If the adjacent side walls are further locked, each side wall may remains upright which is required when used. The usual practice is to provide a groove on a side wall, the groove being close to the edge of the side wall and close to an adjacent side wall. A latch is positioned in the groove, and a recess is provided on the adjacent side wall so as to accommodate the end of the latch. The side walls may be locked or unlocked by making the latch enter or leave the recess.

U.S. Pat. No. 4,923,079 discloses a typical push-pull locking system. The patent discloses a groove on a side wall and a recess on an adjacent wall. The latch may enter the recess through the groove. Further, a spring means is provided to reset the latch and keep the latch in a locked state. When people push or pull the latch away from the recess, the side walls are unlocked, and the side walls can be folded. Similarly, the locking system may also suitable for the small door.

The above method is a very easy way to achieve mutual inter-locking side walls, however, it is difficult when operating the latch.

WO2005102852 discloses a typical rotary locking system. It is mainly characterized in that the latch having a pivot perpendicular to the side wall, when rotate the latch, the end of the pivot enters into or leaves a groove of the adjacent side wall. The latch further includes an elastic blade, so as to drive the latch reset and remain locked.

The patent effectively reduces the force needed to unlock, but it has a certain degree of complexity in the assembly. Further, it has a limited locking strength.

SUMMARY OF THE INVENTION

The aim of the invention is to provide a locking system applicable in large container, which has the advantages of effortless operation, easy installation, and, when in use, improved conformation of movements to gesture habits of people.

In order to achieve the above aim, a locking system applicable in a large container is provided, comprising a first component, a second component, and a latch. The latch is movably received within the first component, and correspondingly the second component is provided with a groove to receive a section of the latch extending from the receiving section of the first component. The locking system also comprises a handle. The handle is arranged on the first component via pivot shafts and is allowed to turn towards an outer side of the first component. The handle is provided at a section thereof away from the pivot shaft with male pins. The latch is provided with concave profiles in correspondence to the male pin. The male pins and the concave profiles are engaged to form a sliding pair. Furthermore, the handle and the latch constitute a lever system. The lever system uses the pivot shaft as a fulcrum, the handle as a driving member, and the latch as a driven member, where the distance between a force-exerting section of the handle and the fulcrum is greater than the distance from the sliding pair to the fulcrum.

The further aspect of the locking system applicable in a large container is that the handle is received in the first component.

The further aspect of the locking system applicable in a large container is that the first component is the first side wall of the large container, and the second component is the second side wall of the large container adjacent to the first side wall, both the first side wall and the second side wall being foldably provided on a base, the pivot shaft being perpendicular to the base.

The further aspect of the locking system applicable in a large container is that the handle is received by a concave portion of the first component, and the opposite sides of the handle are connected to the two opposite sides of the concave portion through the pivot shafts respectively; the male pins are provided on the opposite sides of the handle respectively; the latch is provided with a tongue and control arms extending from two sides of the tongue respectively; the concave profiles are formed on the control arms respectively; the control arms of the latch pass through a hole of the first component, enter into the concave portion and engage with the corresponding male pins through the concave profiles; the tongue of the latch protrudes from the first component and is inserted into the groove of the second component so as to interlock the first component and the second component.

The further aspect of the locking system applicable in a large container is that a spring is provided between the tongue and the side portion of the first component adjacent to the second component, the spring biasing the tongue into the groove of the second component.

The further aspect of the locking system applicable in a large container is that protrusions are provided on the opposite sides of the concave portion respectively, and elongated guiding grooves are provided on the opposite sides of the latch correspondingly; the protrusions are positioned on the guiding grooves respectively so as to ensure the latch moving linearly.

The further aspect of the locking system applicable in a large container is that at least a limiting surface is formed on the concave portion of the first component, the limiting surface(s) being formed at the extreme position of the path along which the handle turn outwardly; the sidewalls of the handle contact face to face with the limiting surface(s) at the extreme position.

The further aspect of the locking system applicable in a large container is that the first component is a door provided on a side wall of the large container, and the second component is the side wall.

The handle is arranged on the first component via pivot shafts and is allowed to turn towards an outer side of the first component. It is easier to be accepted by the user for turning outwardly. Further, the handle is provided at a section thereof away from the pivot shaft with male pins. The latch is provided with concave profiles in correspondence to the male pin. The male pin and the concave profile are engaged to form a sliding pair. The handle and the latch constitute a lever system. There is a distance between a force-exerting section of the handle and position where the male pin is fittingly contact with the concave profile, thus the latch may be driven by the handle under lever principle, which leads to effortless operation. And the movement maybe transferred through installing the male pins into the concave profile, which leads to easy installation.

DETAILED DESCRIPTION

Figure 1:
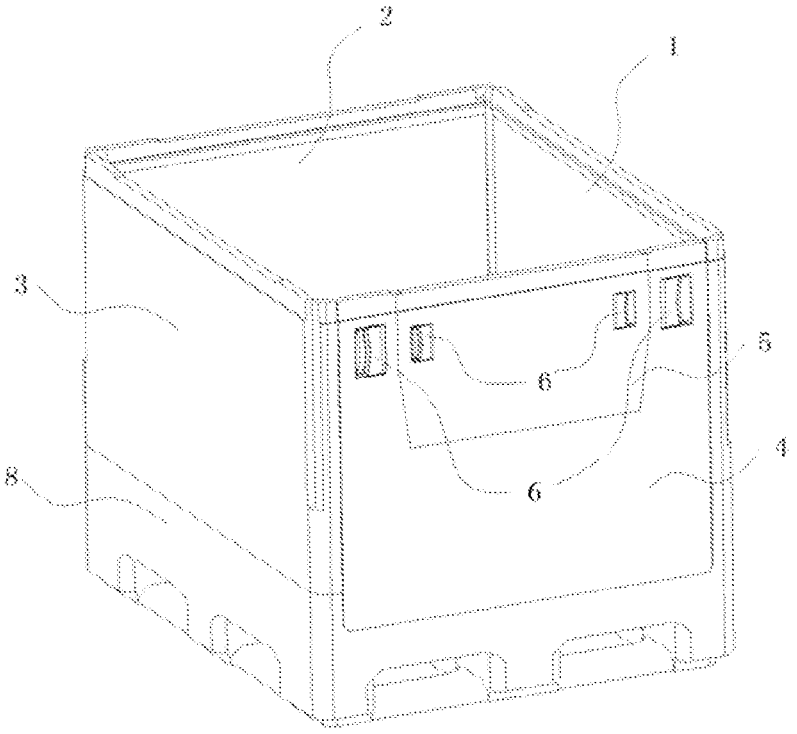
FIG. 1 is a perspective view of a collapsible container.

FIG. 1 shows a collapsible container which comprises a base 8 in form of a rectangular panel structure, wherein the foldable side walls 1, 2, 3, 4 are coupled to the edges of the base 8 by hinges. When the side walls 1, 2, 3, 4 are in the upright position, the side walls are coupled each other through a locking system 6 which will be described later, so that the side walls are kept in the upright state. Optionally, a small door may be provided on a side wall 4, the small door 5 and the side wall 4 are also connected with each other through the locking system 6, so that the small door is keep in a closed state.

Figure 2:
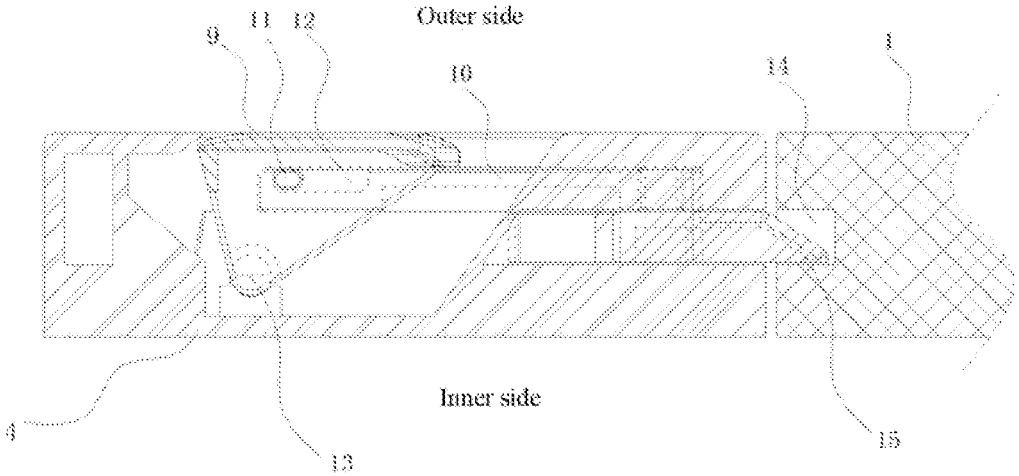
FIG. 2 is a schematic view of the locking system in a locked state.

As shown in FIG. 2, the locking system is mounted on the side wall at a position near the adjacent side wall and comprises a handle 9 and a latch 10.

In FIG. 2, the top of the side wall 4 is the outer side, and the bottom of the side wall 4 is the inner side. When viewed from outer side, the body of the handle 9 is in form of a flat rectangular shape. When viewed from front of FIG. 2, the upper and lower side walls of the handle are in form of a flat triangular shape. Although not shown in the drawing, it is to be understood that when viewed from the left in FIG. 2, the left side wall of the handle is in form of a square flat plate shape. As shown in FIG. 2, the handle 9 is received within the side wall 4, and therefore do not take up additional space.

Figure 4:
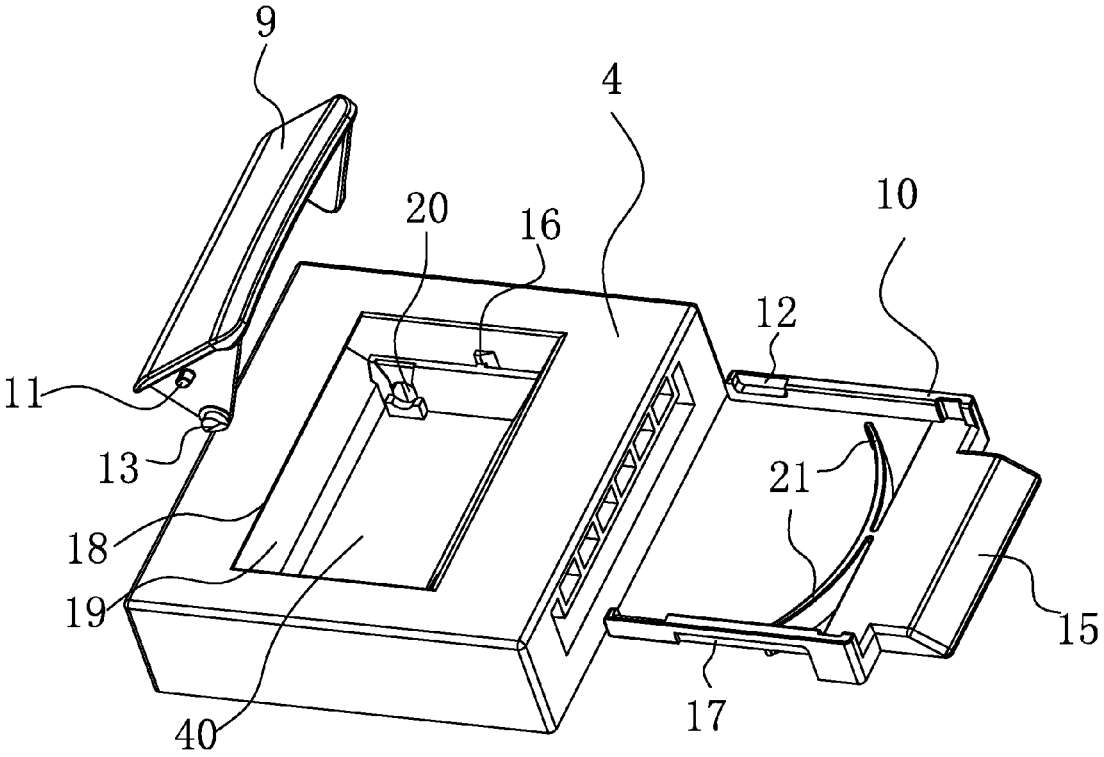
FIG. 4 is an exploded view of the locking system.

As shown in FIG. 4, the latch 10 has a tongue 15 and two control arms 151 projecting from the two sides of the tongue 151 respectively, each control arm 151 having an elongated guiding groove 17 and a concave profile 12. Protrusions 16 are provided on the opposite sides of the concave portion 40 of the side wall 4 respectively so as to engage with the guiding grooves 17 of the control arms 151 correspondingly. The upper and lower side walls of the handle 9 are provided with male pins 11 in correspondence to the concave profile 12 of the control arms.

Figure 3:
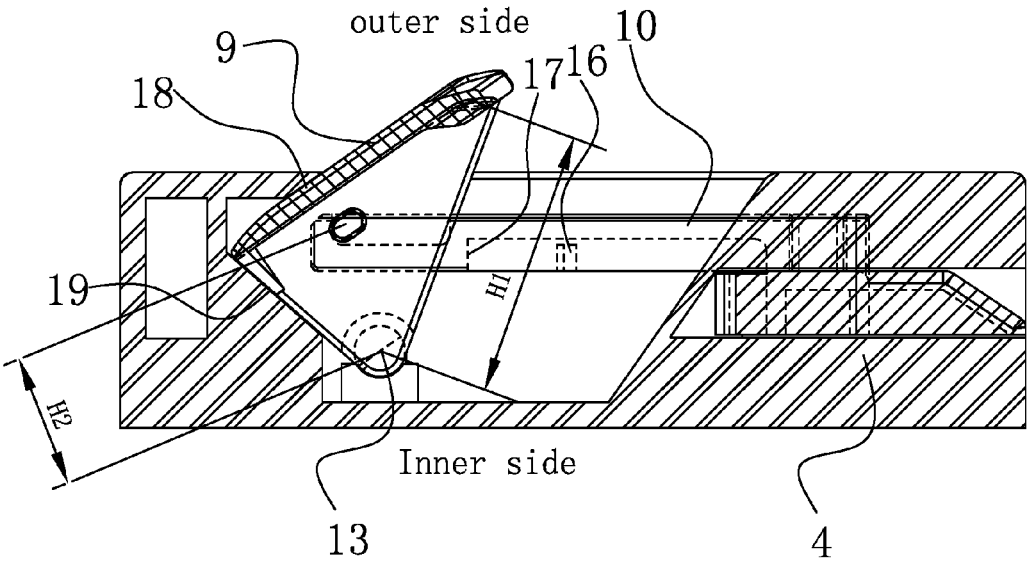
FIG. 3 is a schematic diagram of the unlocking operation of the locking system.

As shown in FIGS. 2 and 3, the male pin 11 and the concave profile 12 are engaged to form a sliding pair for conducting motion. Therefore, the handle 9 and the latch 10 constitute a lever system. The lever system uses the pivot shaft 13 (as shown in FIG. 4) as a fulcrum, and the handle 9 as a driving member for outputting rotation and the latch 10 as a driven member for outputting linear motion, where the distance between a force-exerting section of the handle 9 and the fulcrum is greater than the distance from the sliding pair to the fulcrum.

With continued reference to FIG. 4, the upper and lower side walls of the handle 9 are provided with the pivot shafts 13, and pin holes 20 are provided on the upper and lower sidewalls of the concave portion 40 correspondingly. Pivot shafts 13 are inserted into the pin holes 20 respectively, so that the handle 9 can be turn towards the outside of the side wall 4 around the pivot shaft 13. With reference to FIG. 1, preferably, the pivot shaft 13 is perpendicular to the base 8.

As shown in FIGS. 2 and 3, the tongue 15 of the latch 10 extends into the recess 14 of the side wall 1, and then the side walls 1, 4 are mutually locked.

Since the handle 9 is provided with the pivot shaft 13, when the handle 9 is activated to rotate about the pivot shaft 13, the male pins 11 of the handle 9 are contact with the concave profiles of the latch 10 on the left of the concave profiles, thus drive the latch 10 to move to the left, so that the tongue 15 of the latch 10 disengages from the recess 14 of the side wall 1, thereby releasing the interlock of the side walls 1 and 4.

As shown in FIG. 3, when the locking system is unlocked, the handle 9 is rotated by a preset angle (e.g. about 35 degrees), the limiting surfaces 18, 19 of the side wall 4 are contact face to face with the outer surface and the left side wall of the handle 9 respectively, so that the handle can not be rotated outwardly any more. With reference to FIG. 1, when user grasps the handle 9 and folds the side wall 4 inwardly, the handle 9 will be subjected to a part of the weight of the side wall.

The limiting surfaces 18, 19 of the side wall 4 and the pivot shaft 13 of the handle 9 share the weight effectively, so that the handle will not be easily damaged.

When the latch 10 is inserted into the side wall 4 from outside, the guiding grooves 17 on the latch receive the projections 16 exactly, so that the latch will not disengage from the side wall 4 due to gravity, a pulling force or a restore force by the latch 10 itself.

As shown in FIG. 4, when assembled, first, the latch 10 is inserted into the side wall 4 from the side wall 3, thus the latch 10 can not be released due to being limited by the projections 16. Then, the handle 9 is fitted into the side wall 4 from the front of it, such that the pivot shafts 13 enter into the holes 20 of the side wall 4 respectively. When disassembled, the steps are operated in reverse.

The latch 10 is provided with spring (s), for example, two elastic blades 21 which are interposed between the side wall 4 and the tongue 15, so as to restore the latch 10 and hold it in a locked state, i.e., the tongue 15 protrudes. As the side wall 4 changing from the folded state to the upright state, when rotated to a certain angle, the tongue 15 of the latch 10 will collide with the side wall 1, thus cause the latch to move towards the inner of the side wall 4. The concave contour 10 of the latch 12 is an elongated profile, so that when the latch moves inwardly, the handle 9 will not be driven to rotate.

As shown in FIG. 3, the force-exerting section (the edge of the right side) of the handle 9 is spaced apart from the pivot shaft 13 and the male pin 11 by a certain distance which increases the arm of force. Therefore it is labour-saving for turning the handle 9 according lever principle.

The invention claimed is:

1. A locking system applicable in a large container, comprising:

a first component, a second component, and a latch; wherein the latch is movably received within the first component, and correspondingly the second component is provided with a groove to receive a section of the latch extending from the receiving section of the first component; wherein the locking system further comprises a handle; the handle is arranged on the first component via pivot shafts and is allowed to turn towards an outer side of the first component; the handle is provided at a section thereof away from the pivot shaft with male pins; the latch is provided with concave profiles in correspondence to the male pin; the male pins and the concave profiles are engaged to form a sliding pair, so that the handle and the latch constitute a lever system; the lever system uses the pivot shaft as a fulcrum, the handle being a driving member, and the latch being a driven member, where the distance between a force-exerting section of the handle and the fulcrum is greater than a distance from the sliding pair to the fulcrum, wherein the handle is received b a concave portion of the first component, and the opposite sides of the handle are connected to the two opposite sides of the concave portion through the pivot shafts respectively; the male pins are provided on the opposite sides of the handle respectively; the latch is provided with a tongue and control arms extending from two sides of the tongue respectively; the concave profiles are formed on the control arms respectively; the control arms of the latch pass through a hole of the first component, enter into the concave portion and engage with the corresponding male pins through the concave profiles; the tongue of the latch protrudes from the first component and is inserted into the groove of the second component so as to interlock the first component and the second component.

2. The locking system applicable in a large container according to claim 1, wherein the handle is received in the first component.

3. The locking system applicable in a large container according to claim 1, wherein the first component is the first side wall of the large container, and the second component is the second side wall of the large container adjacent to the first side wall, both the first side wall and the second side wall being foldably provided on a base, the pivot shaft being perpendicular to the base.

4. The locking system applicable in a large container according to claim 1, wherein a spring is provided between the tongue and the side portion of the first component adjacent to the second component, the spring biasing the tongue into the groove of the second component.

5. The locking system applicable in a large container according to claim 1, wherein protrusions are provided on the opposite sides of the concave portion respectively, and elongated guiding grooves are provided on the opposite sides of the latch correspondingly; the protrusions are positioned on the guiding grooves respectively so as to ensure the latch moving linearly.

6. The locking system applicable in a large container according to claim 1, wherein at least a limiting surface is formed on the concave portion of the first component, the limiting surface(s) being formed at the extreme position of the path along which the handle turn outwardly; the sidewalls of the handle contact face to face with the limiting surface(s) at the extreme position.

7. The locking system applicable in a large container according to claim 1, wherein the first component is a door provided on a side wall of the large container, and the second component is the side wall.

* * * * *